US007497745B2

(12) United States Patent
Baertl et al.

(10) Patent No.: US 7,497,745 B2
(45) Date of Patent: Mar. 3, 2009

(54) CONTACT ARRANGEMENT

(75) Inventors: Reinhold Baertl, Lappersdorf (DE); Dieter Dohnal, Lappersdorf (DE); Dieter Geiger, Deuerling (DE); Albert Schmidbauer, Roding (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 451 days.

(21) Appl. No.: 10/574,156

(22) PCT Filed: Jul. 5, 2005

(86) PCT No.: PCT/EP2005/007209

§ 371 (c)(1),
(2), (4) Date: Mar. 28, 2006

(87) PCT Pub. No.: WO2006/021260

PCT Pub. Date: Mar. 2, 2006

(65) Prior Publication Data

US 2008/0248700 A1 Oct. 9, 2008

(30) Foreign Application Priority Data

Aug. 26, 2004 (DE) ..... 10 2004 041 317

(51) Int. Cl.
*H01R 9/24* (2006.01)

(52) U.S. Cl. ..... 439/889

(58) Field of Classification Search ..... 439/889, 439/98, 810, 811, 812, 813, 814, 224, 217, 439/789, 790, 791, 792, 737, 738, 739, 752, 439/801, 603

See application file for complete search history.

(56) References Cited

U.S. PATENT DOCUMENTS

| | | | | |
|---|---|---|---|---|
| 3,784,964 | A * | 1/1974 | Newman et al. | 439/603 |
| 5,201,914 | A * | 4/1993 | Hollick | 439/801 |
| 5,374,781 | A | 12/1994 | Dohnal et al. | 174/153 |
| 6,309,258 | B1 * | 10/2001 | Measley | 439/738 |
| 2002/0049009 | A1 * | 4/2002 | Rabenstein et al. | 439/889 |

FOREIGN PATENT DOCUMENTS

| | | |
|---|---|---|
| AT | 187991 | 2/1956 |
| AT | 315302 | 5/1974 |
| DE | 1181803 | 11/1964 |
| DE | 1952607 | 4/1971 |
| DE | 2705772 | 11/1977 |
| DE | 3801151 | 7/1989 |
| DE | 3801152 | 7/1989 |
| DE | 9010730 | 9/1991 |
| GB | 1352386 | 5/1974 |

* cited by examiner

*Primary Examiner*—Edwin A. Leon
(74) *Attorney, Agent, or Firm*—Andrew Wilford

(57) ABSTRACT

A contact arrangement for use on an insulating rod having an upper fastening bore and a lower fastening bore has a U-shaped contact having a pair of limbs each formed with an upper bore and a lower bore. The contact is fittable around the rod with the limbs flanking the rod and the upper and lower bores of the limbs aligned with the respective upper and lower bores of the rod. Respective upper and lower contact holders each have a pair of mounts flanking the rod and respectively downwardly and upwardly engaging the limbs of the contact. The mounts of the contact holders are formed with bores aligned with the bores of the rod and with the bores of the respective limbs. Dielectric upper and lower pins extend through the bores of the mounts of the holders, the bores of the limbs, and the bores of the rod.

10 Claims, 7 Drawing Sheets

CONTACT ARRANGEMENT

CROSS REFERENCE TO RELATED APPLICATIONS

This application is the US national phase of PCT application PCT/EP2005/007209, filed 5 Jul. 2005, published 2 Mar. 2006 as WO 2006/021260, and claiming the priority of German patent application 102004041317.7 itself filed 28 Aug. 2004, whose entire disclosures are herewith incorporated by reference.

FIELD OF THE INVENTION

The invention relates to a contact arrangement with a fixed electrical contact that is fastened to an insulating rod, for a step switch or tap changer.

BACKGROUND OF THE INVENTION

Step switches and tap changers are known for switching between different winding taps of a regulating transformer for voltage regulation. They have stationary contacts that are electrically connected with the individual winding taps of a regulating transformer and are usually arranged in phases on circular tracks disposed one above the other. In each horizontal plane electrical connection can be made with the stationary contacts by a movable contact, usually a contact bridge, connected with the electrical load shunt. The stationary contacts are in that case fastened to vertically extending insulating rods of hard paper or glass-fiber-reinforced synthetic material or also in the wall of insulating cylinders.

The fastening to insulating rods is hitherto usually carried out in that not only the corresponding insulating rod itself, but also a fastening part of the stationary contact are provided with respective bores and this contact arrangement is tightened together by screws and nuts. Such a contact arrangement with a screw connection is known from FIG. 1 of AT-PS 187991. However, the disadvantage of this fastening, which is simple in itself, consists in that due to the metallic fastening means penetrating the insulating rods the voltage resistance of the entire step switch or tap changer is impaired.

Numerous proposals have already become known for remedying this problem. The mentioned AT-PS 187991 itself describes a further contact arrangement in which clamping members are provided that embrace the respective insulating rods and that are screw-connected outside these insulating rods, so that no metallic fastening means penetrate the insulating rods themselves. A quite similar solution was subsequently proposed once again in AT-PS 315302. Bores through the insulating rods can indeed be avoided by that, but metallic fastening means—even if outside the insulating rods—are still present; the disadvantageous influence thereof on the voltage resistance thus continues to be present.

A further contact arrangement is known from AT-PS 382476, wherein a sleeve is provided at the contact to be fastened, the sleeve having on one side a collar with a diameter greater than the bore diameter of the respective insulating rod. On the other side of the insulating rod the sleeve of the contact to be fastened has an annular groove in which a slotted ring of plastics material is placed. However, this arrangement has not been able to gain acceptance in practice. Insulating material rods usually shrink during the necessary drying of the respective step switch or tap changer prior to being placed in operation; in the case of this known contact arrangement the individual contacts then loosen due to the fastening purely by shape-locking coupling, which is not desirable.

A contact arrangement as well as an associated fastening method are known from DE-PS 3801151 and 3801152, wherein the contact is held by permanent deformation of its sleeve on the outer side, stated more precisely by expansion of bores specifically provided for that purpose. This is relatively costly and requires a special tool for expanding the described bores and beyond that similarly enables only fastening in a shape-locking manner. Finally, disassembly of this contact arrangement without destruction is also not possible.

DE-GM 9010730 proposes a similar contact arrangement; in this case the sleeve of the contact is weakened in its cross-section in a defined region and a bulge-like thickening of the sleeve is achieved at this location by upsetting from the outside, whereby fixing is effected. A special tool is indeed not required for the described upsetting from outside—a hammer suffices—but here, too, there is the disadvantage that, apart from the connection which is again only a shape-locking coupling, disassembly is similarly possible only by destruction of the contact.

DE-PS 4236528 (U.S. Pat. No. 5,374,781) describes a further possibility of fastening a contact by a transverse pin that penetrates the contact sleeve, and locking means cooperating therewith. This connection is detachable without destruction, can also be executed to be force-locking and is also suitable for simultaneous fastening of shield rings. Nevertheless, it was not able gain acceptance, because it is of relatively complicated construction and requires a multiplicity of individual parts produced with a high degree of accuracy relative to one another.

OBJECT OF THE INVENTION

It is accordingly the object of the invention to provide a contact arrangement of the kind described above in which a fixed electrical contact can be fastened to an insulating rod without impairment of the voltage strength taking place due to metallic fastening parts, wherein the contact arrangement moreover is of simple and economic construction, is secured against loosening of the fixed contact and, in addition, can be demounted again without destruction.

SUMMARY OF THE INVENTION

This object is attained by a contact arrangement wherein, apart from the actual contact that is to be fastened to an insulating rod, there is also a two-part contact holder of insulating material as well as pins, similarly of insulating material, for fastening. According to the invention the actual contact is of U-shaped construction. The contact arrangement according to the invention has a number of advantages: no metallic parts of any kind are required for fastening, the entire arrangements consists of only a few parts that can be produced in simple manner and, nevertheless, a secure fastening is possible without special tools. The fastening according to the invention ensures, even in the case of possible shrinkage of the insulating rod or later vibrations in operation, a reliable, secure fastening; finally—again without a special tool—removal in simple manner and without destruction is possible at any time.

According to an advantageous development of the invention additional shield caps that surround the contact at both longitudinal ends of the insulating rod, are fastenable therewith in simple manner.

BRIEF DESCRIPTION OF THE DRAWING

The invention will be explained in more detail in the following by way of example with reference to drawings, in which.

SPECIFIC DESCRIPTION

Figure 1:
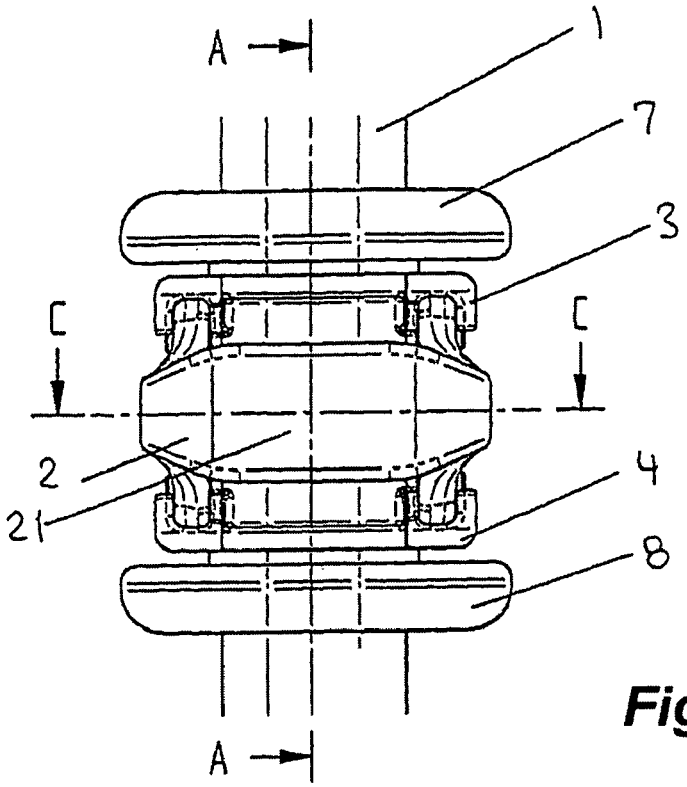
FIG. 1 shows a contact arrangement according to the invention in side view.
Figure 2:
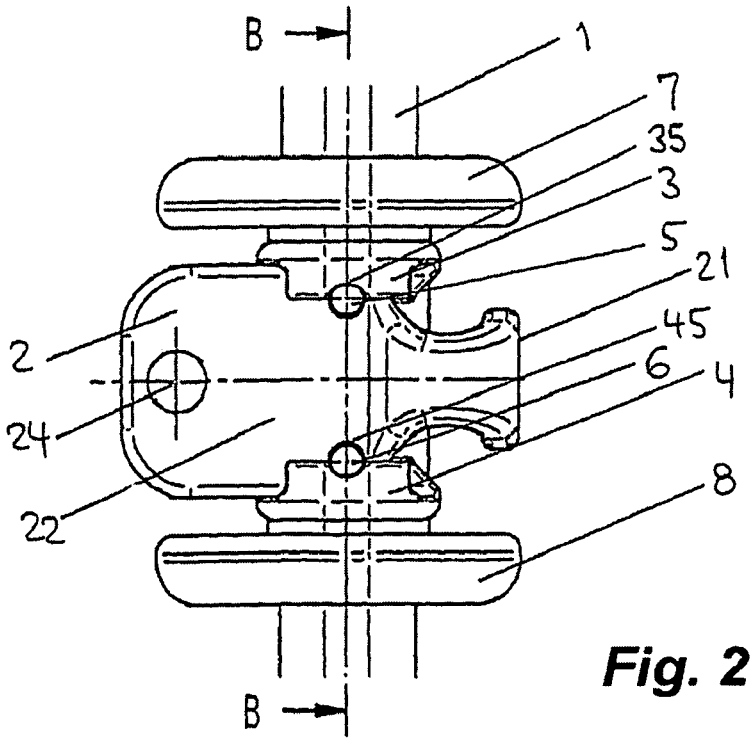
FIG. 2 shows this contact arrangement rotated horizontally through 90°.
Figure 3:
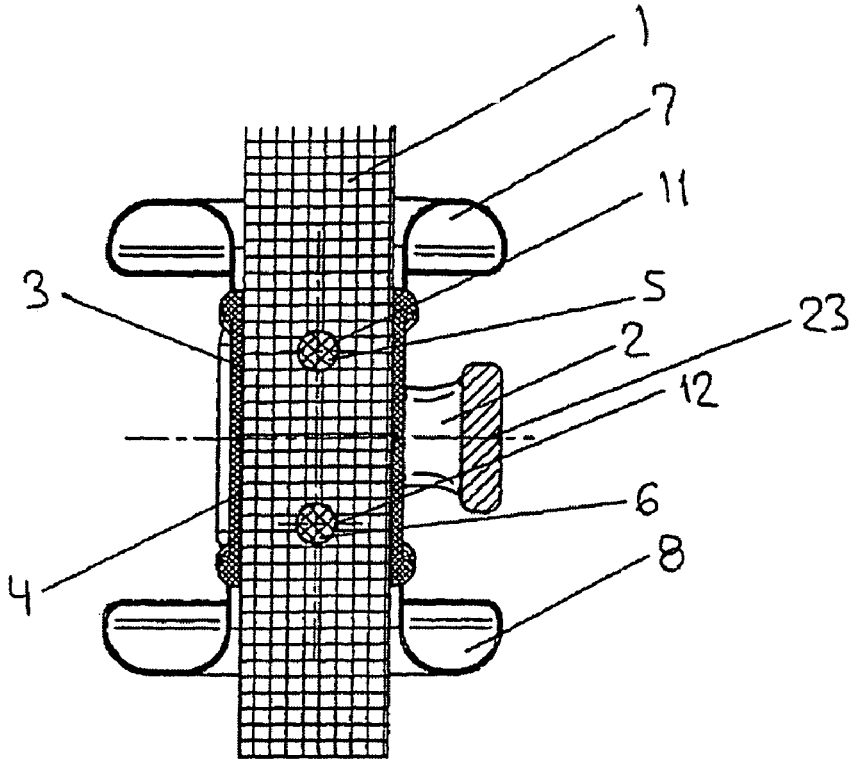
FIG. 3 shows a section in the plane A-A of FIG. 1 through this contact arrangement.
Figure 4:
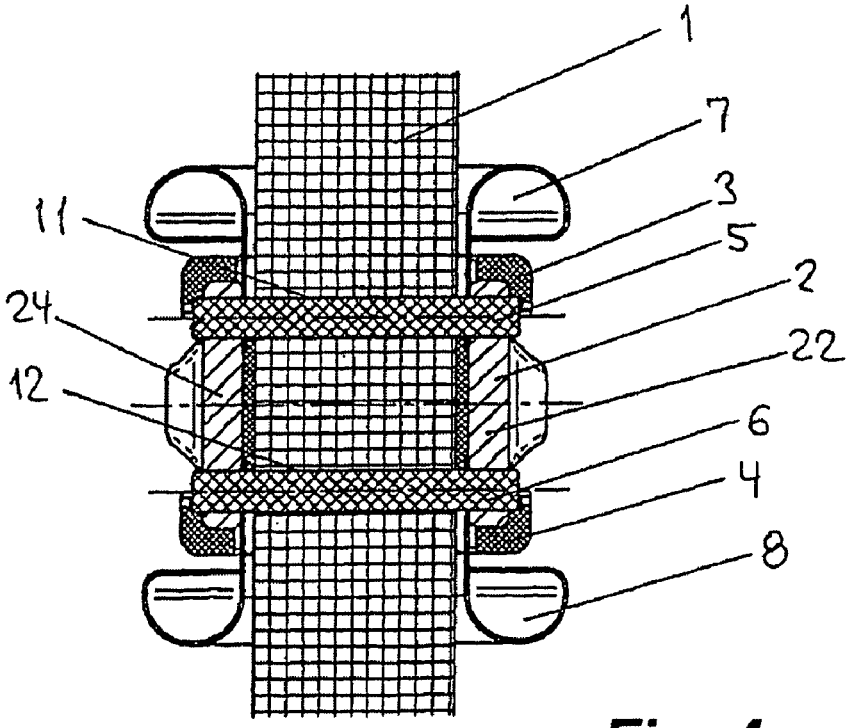
FIG. 4 shows a section in the plane B-B of FIG. 2 through this contact arrangement.
Figure 5:
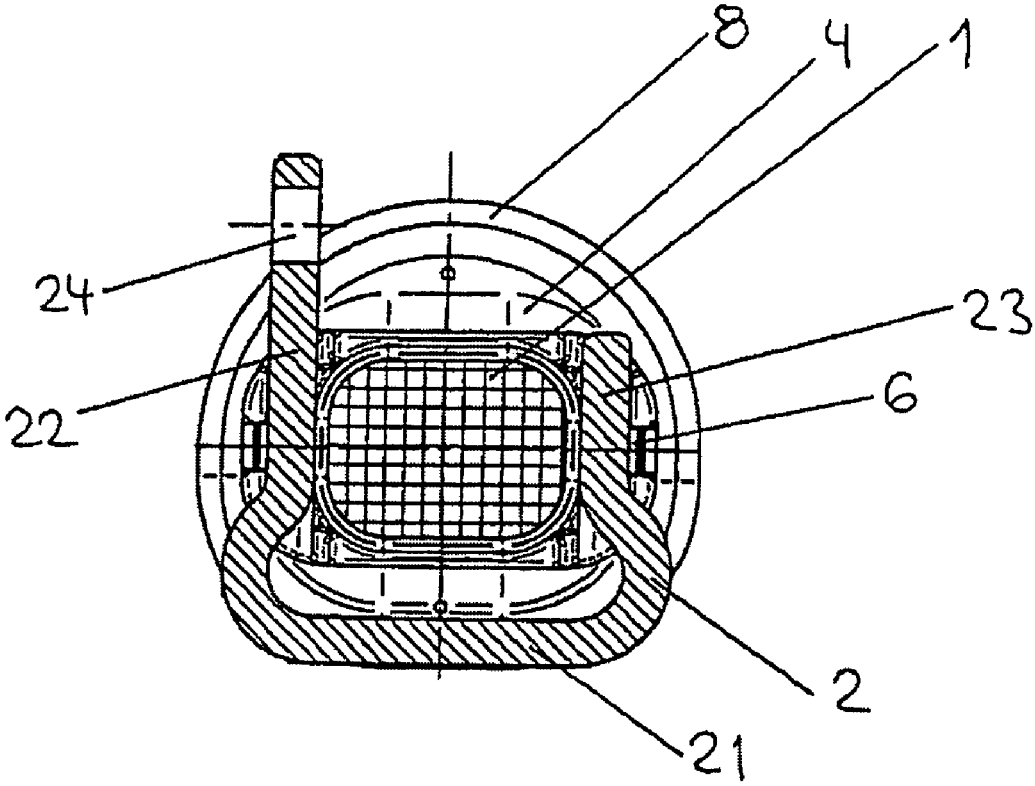
FIG. 5 shows a section in the plane C-C of FIG. 1 through this contact arrangement.
Figure 6:
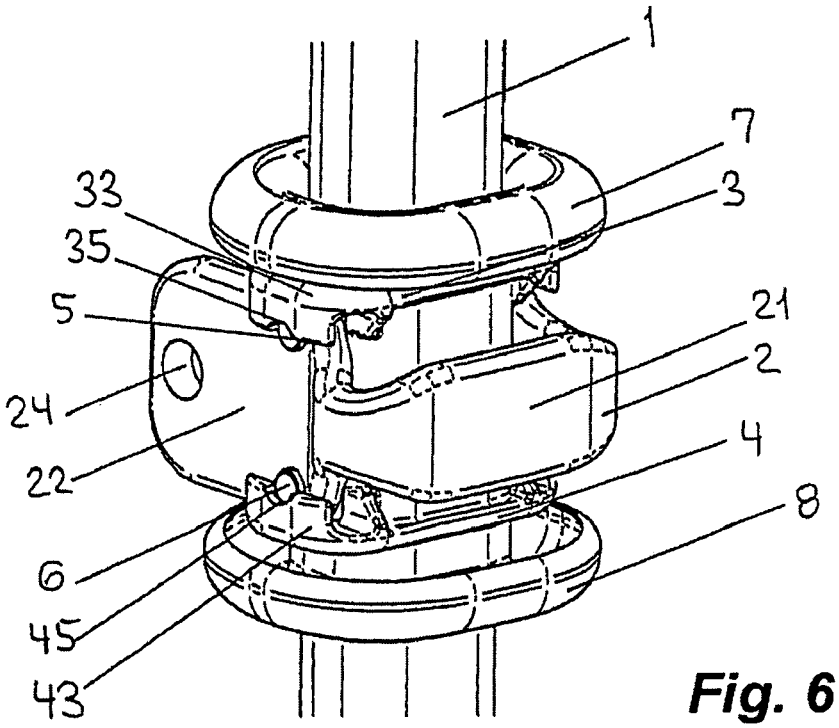
FIG. 6 shows a perspective view of the contact arrangement.
Figure 7:
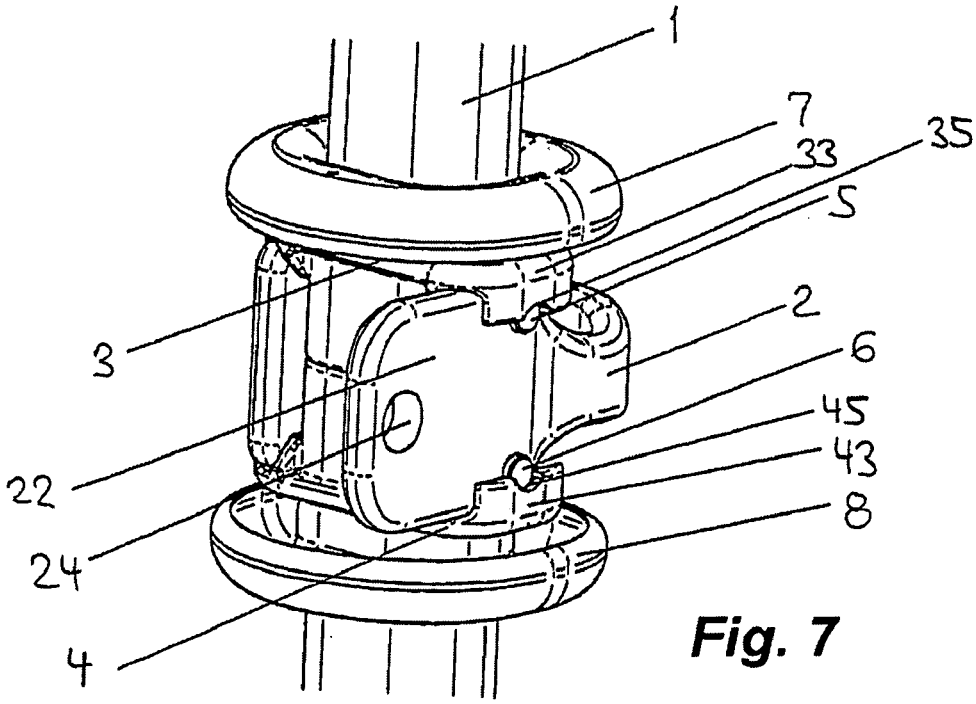
FIG. 7 shows a corresponding view again turned horizontally through 90°.

In FIGS. 1 to 7, which show the entire contact arrangement according to the invention when installed, for reasons of clarity not all reference numerals are entered.

Figure 8:
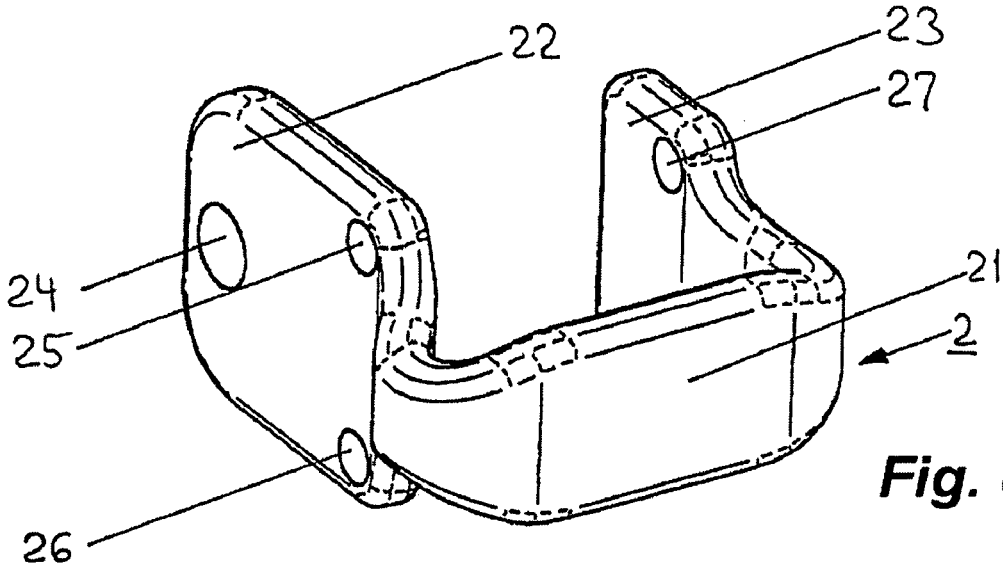
FIG. 8 shows a contact by itself, in perspective view.
Figure 9:
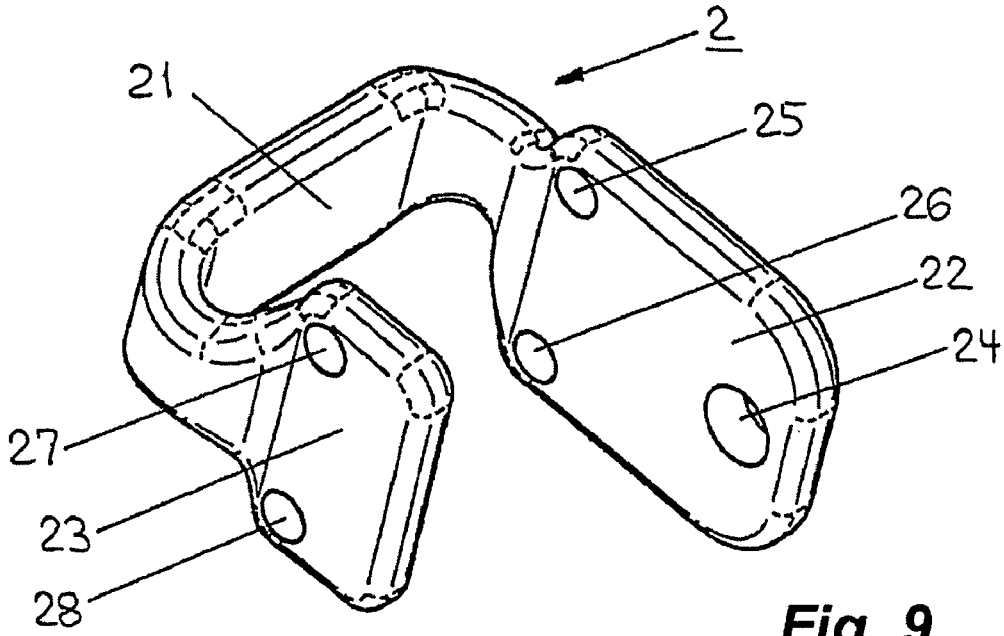
FIG. 9 shows this contact turned through 180°.
Figure 10:
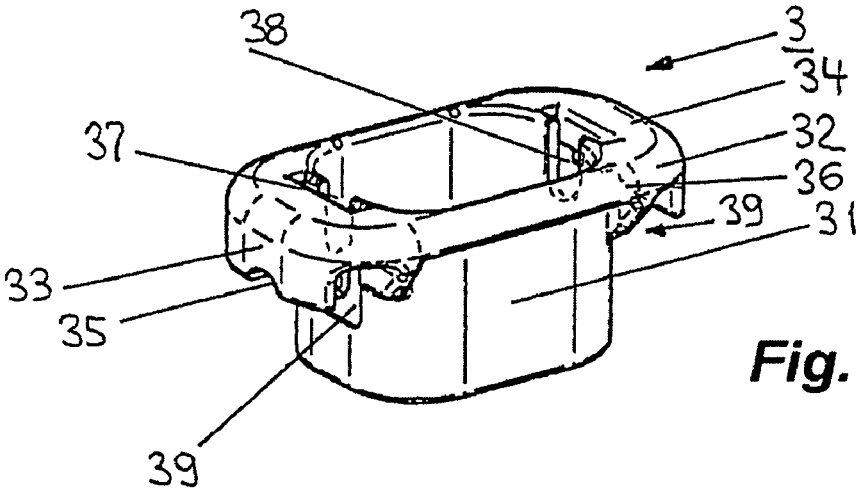
FIG. 10 shows an upper contact holder by itself, in perspective view.
Figure 11:
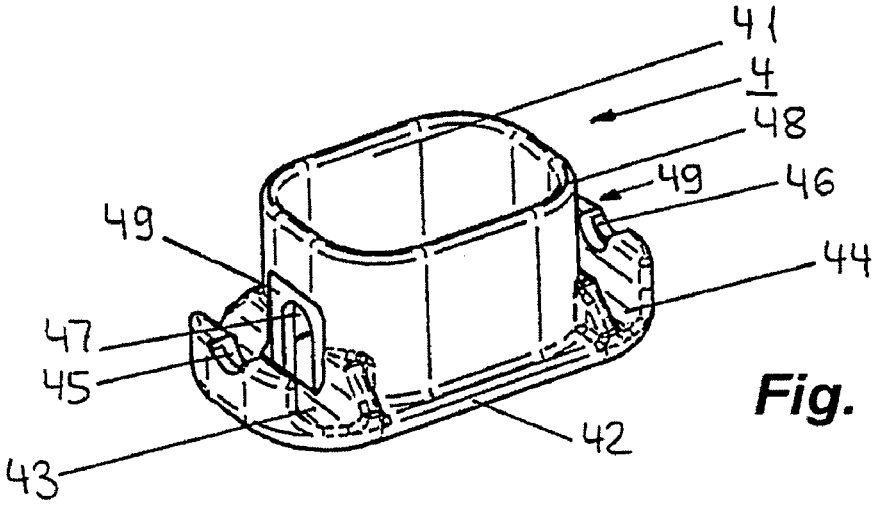
FIG. 11 shows a lower contact holder by itself, in perspective view.
Figure 12:
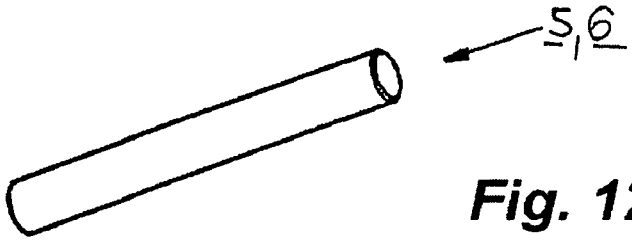
FIG. 12 shows a pin for fastening.
Figure 13:
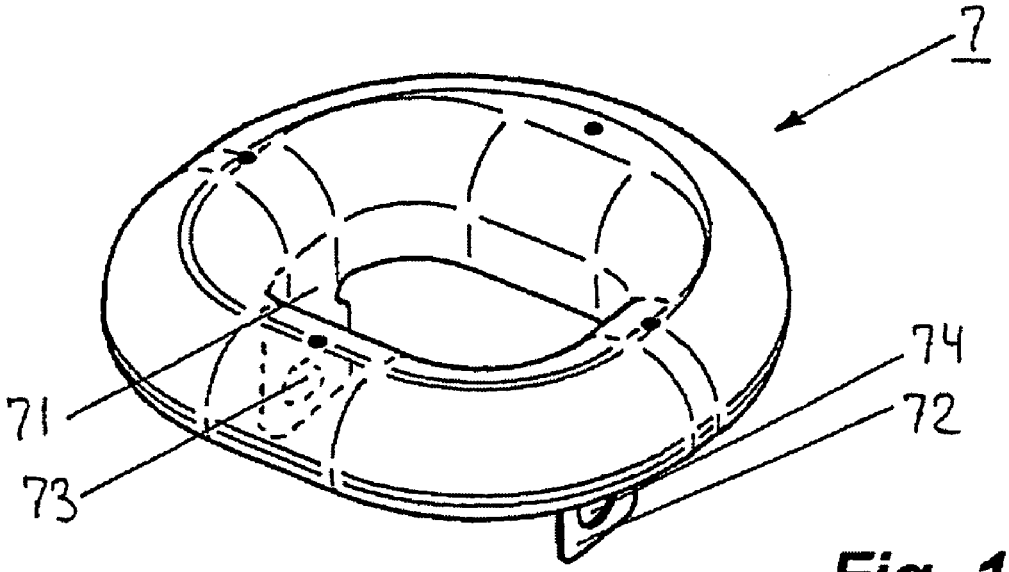
FIG. 13 shows an upper shield ring by itself, in perspective view.
Figure 14:
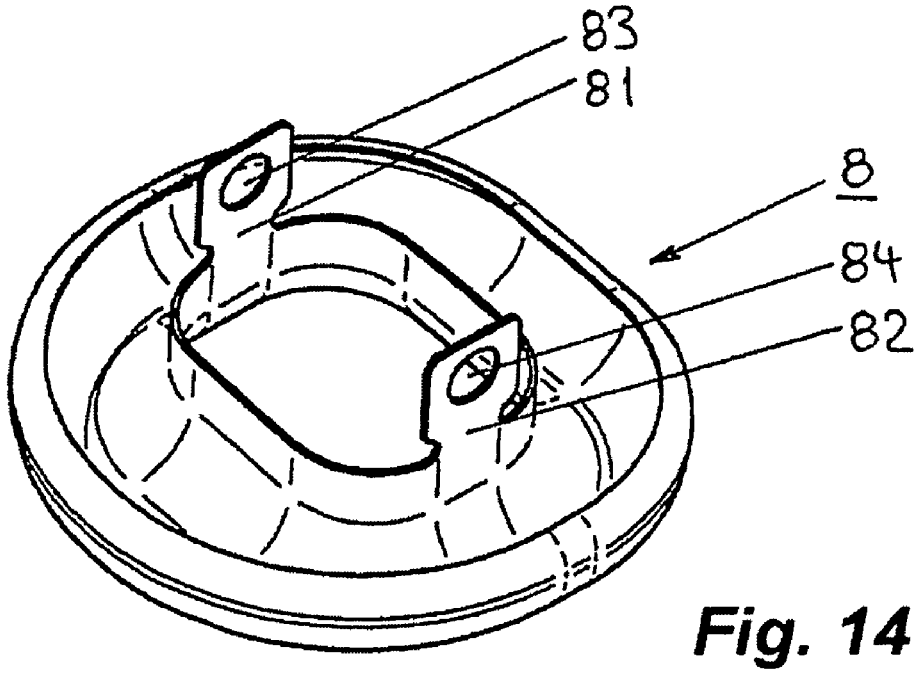
FIG. 14 shows a lower shield ring by itself, in perspective view.

In FIGS. 1 to 7, which illustrate the entire contact arrangement, there is shown an insulating rod 1 to which the contact arrangement according to the invention is to be fastened. The individual parts of the contact arrangement according to the invention are illustrated separately in FIGS. 8 to 14.

The insulating rod 1 has for each contact arrangement that is to be fastened to it a respective upper fastening bore 11 and a respective lower fastening bore 12. The contact 2, which is of U-shape, is mounted on the insulating rod 1. It has a bight forming a contact region 21 where electrical connection can be made at the top and bottom by a movable contact (not illustrated). It also has a long limb 22 and a short limb 23, a connecting bore 24 with which the electrical connecting line (not illustrated here) for the respective winding tap of the regulating transformer is connectable being formed in the long limb 22. The long limb 22 also has an upper part fastening bore 25 and a lower fastening bore 26. The short limb 23 extends on the opposite side of the insulating rod 1 parallel to the long limb 22 and similarly has an upper fastening bore 27 as well as a lower fastening bore 28. The fastening bores 25, 27 and 26, 28 correspond with the fastening bores 11 and 12 that extend through the insulating rod 1. At the top, the contact 2 is fixed by an upper contact holder 3. The contact holder 3 has a guide sleeve 31 whose internal dimensions correspond with the external dimensions of the insulating rod 1. It is pushed onto this insulating rod 1. It also has an encircling collar 32, at which lateral, integrally formed contact mounts 33 and 34 disposed opposite one another are provided. In the mounted state the upper region of the long limb 22 of the contact 2 rests in the contact mount 33 and the upper region of the short limb 23 correspondingly rests in the contact mount 34. Seats 35, 36 that are similarly disposed opposite one another, for a pin 5, which is explained still later, are provided in the region of the contact mounts 33, 34. Finally, a bore 37 is formed there and, on the opposite side, a further bore 38 through the guide sleeve 31.

From the bottom the contact 2 is surrounded in the mounted state by a lower contact holder 4. The lower contact holder 4 is constructed identically to the already described upper contact holder 3. It is pushed from below onto the contact rod 1. It again has in entirely analogous manner a guide sleeve 41 on which is integrally formed an encircling collar 42 that in turn has lateral integrally formed contact mounts 43 and 44. The lower region of the long limb 22 rests in the contact mount 43 and the lower region of the short limb 23 rests in the contact mount 44. Seats 45 and 46 and bores 47 and, opposite thereto, 48 are again disposed in this region.

For fastening, only an upper pin 5 and a lower pin 6, both of insulating material, for example glass-fiber synthetic material are now required. The upper pin 5 is fitted horizontally from outside through the upper fastening bore 25 of the long limb 22 of the contact 2, further through the bore 37 of the upper contact holder 3, on through the upper fastening bore 11 of the insulating rod 1, further through the bore 38 of the upper contact holder 3 on the opposite side and finally through the upper fastening bore 27 of the opposite short limb 23 of the contact 2 and then points outward again on the opposite side.

Correspondingly, the lower pin 6 is fitted initially through the lower fastening bore 26 of the long limb 22 of the contact 2, further through the bore 47 of the lower contact holder 4, on through the lower fastening bore 12 of the insulating rod 1, then through the bore 48 on the opposite side of the lower contact holder 5 and finally through the lower fastening bore 28 in the short limb 23 of the contact 2, before it similarly goes out again on the opposite side.

A reliable fastening of the contact 2 to the insulating rod 1 is thus provided. Due to the contact holders 3 and 4 arranged at the top and the bottom on both sides, the contact 2 is reliably fixed and solidly held under all operating conditions. The pins 5 and 6 have such lengths that they rest laterally on the corresponding seats 35, 36 for the upper pin 5 or seats 45, 46 for the lower pin 6.

According to an advantageous development of the invention the outer regions of the seats 35, 36 are vertically offset by a small amount relative to the upper fastening bore 11 and those of the seats 45, 46 relative to the lower fastening bore 12, so that, due to the limited resilience of the components the introduced pins 5 and 6 are pressed during mounting axially against the outer regions of the seats 35, 36 or 45, 46 until in the final mounting position these seats snap closed in their outer region and the respective pin is thereby axially secured. This prevents unintended slipping out.

According to a development of the invention an upper shield cap 7 and a lower shield cap 8 are also provided. The open sides of the shield caps 7 and 8 face the respective contact member 2. The upper shield cap 7 has a first fastening strap 71 and, opposite thereto, a second fastening strap 72 formed with respective bores 73 and 74. The upper shield cap 7 is pushed from above onto the insulating rod 1 so that the fastening straps 71, 72 point downward. In entirely analogous manner the identically constructed shield cap 8 in the pushed-on state has an upwardly pointing first fastening strap 81 and, opposite thereto, a second fastening strap 82 formed with respective bores 83 and 84. The fastening straps 71, 72 or 81, 82 as well as the bores 73, 74 or 83, 84 therein are dimensioned in such a manner that the fastening pins 5 and 6 in the mounted state also extend through these bores, whereby the shield caps 7 and 8 in common with the contact 2 and upper contact holder 3 as well as lower contact holder 4 are fastened to the insulating rod 1 without additional fastening means being required. The electrical contact between the respective shield cap 7 or 8 and the contact 2 is achieved by means of the respective pre-bent fastening straps 71, 72 or 81, 72. Moreover, side edges of the straps 71, 72 or 81, 82 that are guided in the pockets 39, 49 of the respective contact holder 3, 4 so as to be positively mechanically coupled thereto prevent lateral twisting.

In practice, the contact 2 is installed by being brought to the corresponding side of the insulating rod 1 to which it is to be fastened. Subsequently, the upper contact holder 3 is pushed onto the insulating rod 1 from above and the lower contact holder 4 from below. The two contact holders 3 and 4 fix the contact 2. Subsequently, the upper shield cap 7 can be pushed onto the insulating rod from above and the lower shield cap 8 from below.

The following bores are aligned in an upper horizontal plane in the setting provided for fixing:

Upper fastening bore 25 of the contact 2, bore 37 of the upper contact holder 3, bore 73 of the shield cap 7, upper fastening bore 11 of the insulating rod 1, bore 74 of the upper shield cap 7, bore 38 of the upper contact holder 3 and upper fastening bore 27 of the contact 2.

The upper pin 5 is horizontally pushed in through these aligned bores. In the pushed-in state the upper pin 5 rests laterally at its free ends on the inner seat 35 or on the other side on the inner seat 36.

Correspondingly, the following bores are aligned in a lower horizontal setting:

Lower fastening bore 26 of the contact 2, bore 47 of the lower contact holder 4, bore 83 of the lower shield cap 8, lower fastening bore 12 of the insulating rod 1, bore 84 of the lower shield cap 8, bore 48 of the lower contact holder 4 and lower fastening bore 28 of the contact 2.

The lower pin 6 is pushed in horizontally through these aligned bores. In the pushed-in state the lower pin 6 rests laterally by its free ends on the inner seat 45 or on the other side on the inner seat 46.

Overall, the described contact arrangement according to the invention has, apart from the actual conductive contact 2 that is fastened to the insulating rod 1, thus only three different further components:

a contact holder that can, for example, be produced economically as an injection-molded part from plastic and that is pushed onto the insulating rod 1 not only as upper contact holder 3, but also when rotated through 180 degrees as an identical lower contact holder 4, a shield cap that can easily be made from sheet metal and that is pushed onto the insulating rod not only as upper shield cap 7, but also when rotated through 180 degrees as an identical lower shield cap 8, and simple identical pins of insulating material that serve as upper fastening pin 5, but also as lower fastening pin 6.

The invention claimed is:

1. A contact arrangement for use on an insulating rod having an upper fastening bore and a lower fastening bore, the arrangement comprising:

a U-shaped contact having a pair of limbs each formed with an upper bore and a lower bore, the contact being fittable around the rod with the limbs flanking the rod and the upper and lower bores of the limbs aligned with the respective upper and lower bores of the rod;

respective upper and lower contact holders each having a pair of mounts flanking the rod and respectively downwardly and upwardly engaging the limbs of the contact, the mounts of the upper contact holder being formed with bores aligned with the upper bore of the rod and with the upper bores of the respective limbs and the mounts of the lower contact holder being formed with bores aligned with the lower bore of the rod and with the lower bores of the respective limb;

an upper pin extending through the bores of the mounts of the upper holder, the upper bores of the limbs, and the upper bore of the rod; and a lower pin extending through the bores of the mounts of the lower holder, the lower bores of the limbs, and the lower bore of the rod.

2. The contact arrangement according to claim 1 wherein each contact holder has a guide sleeve that surrounds the insulating rod and on which is integrally formed an encircling collar which the mounts are arranged opposite one another.

3. The contact arrangement according to claim 1 wherein the upper contact holder and lower contact holder are identical.

4. The contact arrangement defined in claim 1 wherein the holders and pins are dielectric.

5. The contact arrangement according to claim 1, further comprising:

an upper and a lower shield cap having open sides that each face the contact, each shield cap having a pair of lateral fastening straps each formed with a respective bore, each shield cap being fastened to the insulating rod in such a manner that respective pins also pass through the bores of the respective straps.

6. The contact arrangement according to claim 1 wherein respective seats for the pins are provided in the region of the contact mounts.

7. The contact arrangement according to claim 6 the wherein outer regions of the seats are vertically offset by a small amount relative to the respective bore of the respective mount at the insulating rod in such a manner that the respective pin is axially fixed.

8. The contact arrangement defined in claim 5 wherein the caps are of metal.

9. The contact arrangement according to claim 5 wherein side edges of the fastening straps fit in respective lateral pockets of the respective contact holders.

10. The contact arrangement according to claim 5 wherein the upper shield cap and the lower shield cap are identical.

* * * * *